US009135902B2

(12) United States Patent
Yoshino

(10) Patent No.: US 9,135,902 B2
(45) Date of Patent: Sep. 15, 2015

(54) ELECTRONIC CYMBAL

(71) Applicant: ROLAND CORPORATION, Shizuoka (JP)

(72) Inventor: Kiyoshi Yoshino, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 61 days.

(21) Appl. No.: 14/190,106

(22) Filed: Feb. 26, 2014

(65) Prior Publication Data

US 2014/0298978 A1 Oct. 9, 2014

(30) Foreign Application Priority Data

Apr. 9, 2013 (JP) ..... 2013-081467

(51) Int. Cl.

| | |
|---|---|
| ***G10H 1/32*** | (2006.01) |
| ***G10H 3/14*** | (2006.01) |
| ***G10H 7/02*** | (2006.01) |

(52) U.S. Cl.

CPC ..... *G10H 1/32* (2013.01); *G10H 3/143* (2013.01); *G10H 3/146* (2013.01); *G10H 7/02* (2013.01)

(58) Field of Classification Search

CPC ..... G10H 3/146; G10H 2220/525; G10H 2230/331; G10H 2230/281; G10H 1/32; G10H 2230/305; G10H 2230/321; G10H 2230/285; G10H 3/10; G10H 3/143; G10H 2220/561; G10H 2220/461; G10H 2220/565; G10H 2230/301; G10H 3/14

See application file for complete search history.

(56) References Cited

U.S. PATENT DOCUMENTS

| | | | | |
|---|---|---|---|---|
| 6,072,112 | A * | 6/2000 | Suenaga et al. | 84/422.3 |
| 6,632,989 | B2 | 10/2003 | Yoshino et al. | |
| 6,881,885 | B2 | 4/2005 | Yoshino et al. | |
| 2002/0059861 | A1 * | 5/2002 | Yoshino et al. | 84/402 |
| 2005/0145101 | A1 * | 7/2005 | Yoshino | 84/723 |
| 2006/0156910 | A1 * | 7/2006 | Yoshino | 84/723 |
| 2012/0118130 | A1 * | 5/2012 | Field | 84/730 |
| 2014/0116227 | A1 * | 5/2014 | Yoshino | 84/402 |
| 2014/0298978 | A1 * | 10/2014 | Yoshino | 84/743 |

FOREIGN PATENT DOCUMENTS

| | | |
|---|---|---|
| JP | 08-272359 | 10/1996 |
| JP | 11-272266 | 10/1999 |
| JP | 2003-271134 | 9/2003 |
| JP | 2009-145559 | 7/2009 |
| JP | 2009-145561 | 7/2009 |
| JP | 2009-156886 | 7/2009 |

* cited by examiner

*Primary Examiner* — Marlon Fletcher
(74) *Attorney, Agent, or Firm* — Jianq Chyun IP Office

(57) ABSTRACT

An electronic cymbal includes a disk-shaped main body portion and a striking sensor. A covering member is provided to cover an outer circumferential edge portion of the main body portion and includes an upper covering portion covering an upper surface side of the main body portion, an extending portion extending further toward an outer circumferential side than the outer circumferential edge portion of the main body portion, a lower covering portion covering a lower surface side of the main body portion. The striking sensor at least includes an edge sensor between the lower surface of the main body portion and the lower covering portion, and by pressing down the extending portion, the lower covering portion is elastically deformed in a direction toward the main body portion to sandwich the edge sensor with the lower covering portion and the main body portion and press the edge sensor.

19 Claims, 8 Drawing Sheets

ELECTRONIC CYMBAL

CROSS-REFERENCE TO RELATED APPLICATIONS

This application claims the priority benefit of Japan application serial no. 2013-081467, filed on Apr. 9, 2013. The entirety of the above-mentioned patent application is hereby incorporated by reference herein and made a part of this specification.

BACKGROUND OF THE INVENTION

1. Field of the Invention

The present invention relates to an electronic cymbal. More particularly, the present invention relates to an electronic cymbal capable of suppressing an erroneous detection of a striking sensor.

2. Description of Related Art

In conventional technology, use of an electronic cymbal that simulates an acoustic cymbal, includes detecting a position struck by a stick or the like by a striking sensor and controlling a sound source based on the struck position to generate a musical sound.

For example, Japanese Patent Publication No. 2003-271134 has disclosed an electronic cymbal that includes a piezoelectric sensor 13, a cup portion sheet sensor 19, and an edge portion sheet sensor 18 (Patent Literature 1). The piezoelectric sensor 13 (vibration sensor) can detect a stroke on any of a cup portion 12a, an edge portion 12c, and a bow portion 12b. Here, the cup portion 12a is part of the upper surface side of a cymbal main body portion and is a part formed on the central part of the main body portion. In addition, the edge portion 12c is a part formed on the peripheral edge of the cymbal main body portion, namely, the outer circumferential edge portion of the main body portion. Furthermore, the bow portion 12b is part of the upper surface side of the cymbal main body portion and is a middle part formed between the aforementioned cup portion 12a and the edge portion 12c. The cup portion sheet sensor 19 can detect pressing on the cup portion 12a. The edge portion sheet sensor 18 (edge sensor) can detect pressing on the edge portion 12c.

According to the Patent Literature 1, when the piezoelectric sensor 13 and the edge portion sheet sensor 18 both generate output, it is determined that the edge portion 12c is struck. In addition, when the piezoelectric sensor 13 and the cup portion sheet sensor 19 both generate output, it is determined that the cup portion 12a is struck. On the other hand, if only the piezoelectric sensor 13 has an output, it is determined that the bow portion 12b is struck.

However, in the aforementioned conventional electronic cymbal, the edge portion sheet sensor 18 (edge sensor) is disposed on the upper surface side of the bow portion 12b that is close to the edge portion 12c. As a result, when the performer who intends to strike the bow portion 12b strikes the part near the edge portion 12c, the edge portion sheet sensor 18 would be pressed, causing the problem of erroneous determination of the stroke on the edge portion 12c.

PRIOR ART LITERATURE

Patent Literature

[Patent Literature 1] Japanese Patent Publication No. 2003-271134 (Paragraph [0034] and FIG. 1, etc.)

SUMMARY OF THE INVENTION

In view of the above, the present invention provides an electronic cymbal capable of suppressing an erroneous detection of a striking sensor.

Solution to the Problem and Effect of the Invention

According to an electronic cymbal recited in an embodiment, an extending portion of a covering member extends further to an outer side than an outer circumferential edge portion of a main body portion. Thus, the extending portion is struck when the performer strikes the outer circumferential edge portion (edge) of the main body portion with a stick or the like. At this time, as the extending portion is struck and pushed down, the lower covering portion is elastically deformed in a direction toward the main body portion. As a result, an edge sensor is sandwiched and pressed between the lower covering portion and the lower surface side of the main body portion.

In this way, the stroke on the extending portion can be detected through the edge sensor disposed on the lower surface side of the main body portion, and thus disposition of the edge sensor on the upper surface side of the main body portion can be avoided. Therefore, it is possible to suppress the problem that the striking sensor erroneously determines the stroke on the upper surface side of the main body portion as a strike on the outer circumferential edge portion of the main body portion.

In addition to the aforementioned effects achieved by the electronic cymbal, in another embodiment, the electronic cymbal further includes the following effects. Because the hardness of the covering member is set to 80 degrees (Shore A) or more, elastic deformation of the extending portion under the stroke can be reduced. Therefore, as the extending portion is pushed down, the lower covering portion can be easily displaced in the direction toward the main body portion.

Furthermore, by increasing the hardness of the covering member to 80 degrees (Shore A) or more, the striking feeling of striking the extending portion with a stick or the like can be similar to the feeling of striking the acoustic cymbal.

That is, if the hardness of the covering member is less than 80 degrees (Shore A), the friction between the stick and the extending portion increases, as compared with the case of striking the acoustic cymbal with the stick, etc, and thus the stick would be easily caught by the covering member and give the performer a feeling of incongruity that is much different from the feeling of striking the acoustic cymbal.

In contrast thereto, by setting the hardness of the covering member to 80 degrees (Shore A) or more, it is possible to prevent the stick from being caught by the covering member when striking with the stick. Thus, it can give the performer the striking feeling similar to striking the acoustic cymbal.

Meanwhile, because the hardness of the covering member is set to 95 degrees (Shore A) or less, even when the stroke on the extending portion is weak, the lower covering portion can still be elastically deformed. Therefore, the edge sensor can perform accurate detection.

In addition to the aforementioned effects achieved by the electronic cymbal, in another embodiment, the electronic cymbal further includes the following effects. The lower surface of the main body portion is supported by a plurality of first upright portions that are disposed upright with an interval therebetween in a circumferential direction of the main body portion. Therefore, it is possible to suppress the main body portion and the lower covering portion from moving close to each other under the impact of the stroke on the upper surface side of the main body portion. Accordingly, it is possible to prevent the edge sensor from being sandwiched and pressed between the main body portion and the lower covering portion, thereby suppressing erroneous detection of the edge sensor.

In addition, since the lower surface of the main body portion is supported by the first upright portions, vibration of the main body portion can be attenuated early, so as to improve the detection accuracy of the vibration sensor.

On the other hand, the first upright portions can be elastically deformed easily when the extending portion is struck. Therefore, the lower covering portion can be displaced in the direction toward the main body portion. In this way, the edge sensor can be easily sandwiched and pressed by the main body portion and the lower covering portion to accurately detect the stroke on the extending portion.

In addition to the aforementioned effects achieved by the electronic cymbal, in another embodiment, the electronic cymbal further includes the following effects. In each of a pair of sheet sensors, electrode portions and a resist are arranged side by side and alternately along a circumferential direction of a film member. In this way, contact of the electrode portions can be prevented except for specific performance operations, such as striking on the outer circumferential edge portion of the main body portion. As a result, the erroneous detection of the edge sensor can be suppressed.

In addition to the aforementioned effects achieved by the electronic cymbal, in another embodiment, the electronic cymbal further includes the following effects. The pair of sheet sensors is disposed between the lower surface of the main body portion and the lower covering portion in a manner where positions of the electrode portions and the second upright portions match each other in the circumferential direction. Thus, when a specific performance operation, such as striking the outer circumferential edge portion of the main body portion, is performed, the electrode portions can be pushed close to the main body portion by the second upright portions that are pushed up by the elastic deformation of the lower covering portion. As a result, the electrode portions can be sandwiched by the lower surface of the main body portion and the second upright portions to be in contact with each other, so as to achieve accurate detection of the sheet sensors.

In addition to the aforementioned effects achieved by the electronic cymbal, in another embodiment, the electronic cymbal further includes the following effects. Through engagement of an engaging hole formed in the pair of sheet sensors and a protruding portion protruding on the covering member, phase of the electrode portions in the pair of sheet sensors and the second upright portions of the covering member can be easily matched in the circumferential direction. Therefore, the installation process of installing the covering member to the main body portion can be simplified.

DESCRIPTION OF THE EMBODIMENTS

Figure 1A:
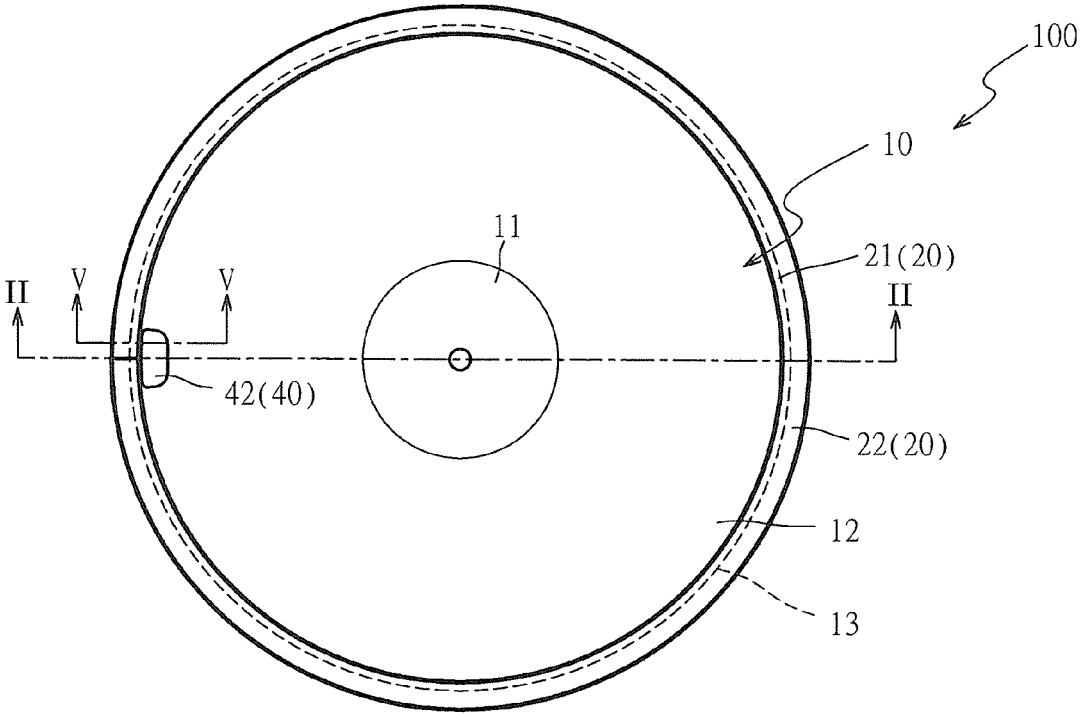
FIG. 1A is a schematic top view of an electronic cymbal in an exemplary embodiment of the present invention.
Figure 1B:
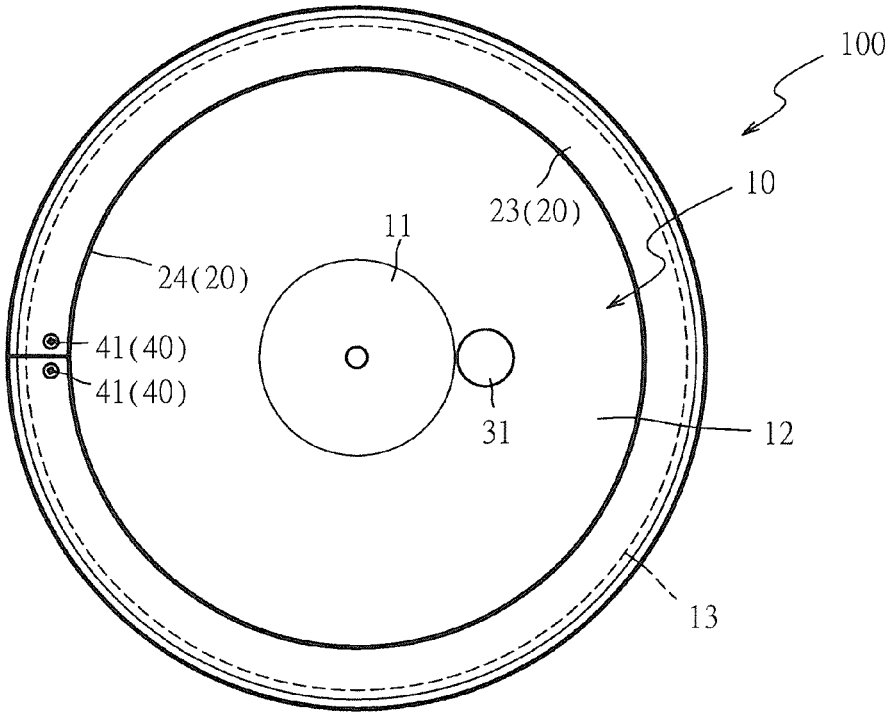
FIG. 1B is a schematic bottom view of the electronic cymbal.

Below preferable exemplary embodiments of the present invention are described in detail with reference to the affixed figures. First, referring to FIG. 1A and FIG. 1B, an external structure of an electronic cymbal 100 in an exemplary embodiment of the present invention is described hereinafter. FIG. 1A is a schematic top view of the electronic cymbal 100 in an exemplary embodiment of the present invention. FIG. 1B is a schematic bottom view of the electronic cymbal 100. In FIG. 1A and FIG. 1B, an edge portion 13 of a main body portion 10 is illustrated schematically by dashed lines.

As shown in FIG. 1A and FIG. 1B, the electronic cymbal 100 is an electronic percussion instrument that simulates an acoustic cymbal. The electronic cymbal 100 mainly includes the main body portion 10, a covering member 20, a vibration sensor 31, and an edge sensor 32. The main body portion 10 is formed in a disk shape. The covering member 20 is installed to cover the main body portion 10. The vibration sensor 31 is configured to detect a stroke on the main body portion 10 or the covering member 20. The edge sensor 32 (see FIG. 4A) is configured to detect a specific performance operation performed on the covering member 20. The main body portion 10 and the covering member 20 are fixed by a fixing member 40 that will be described later.

Figure 2:
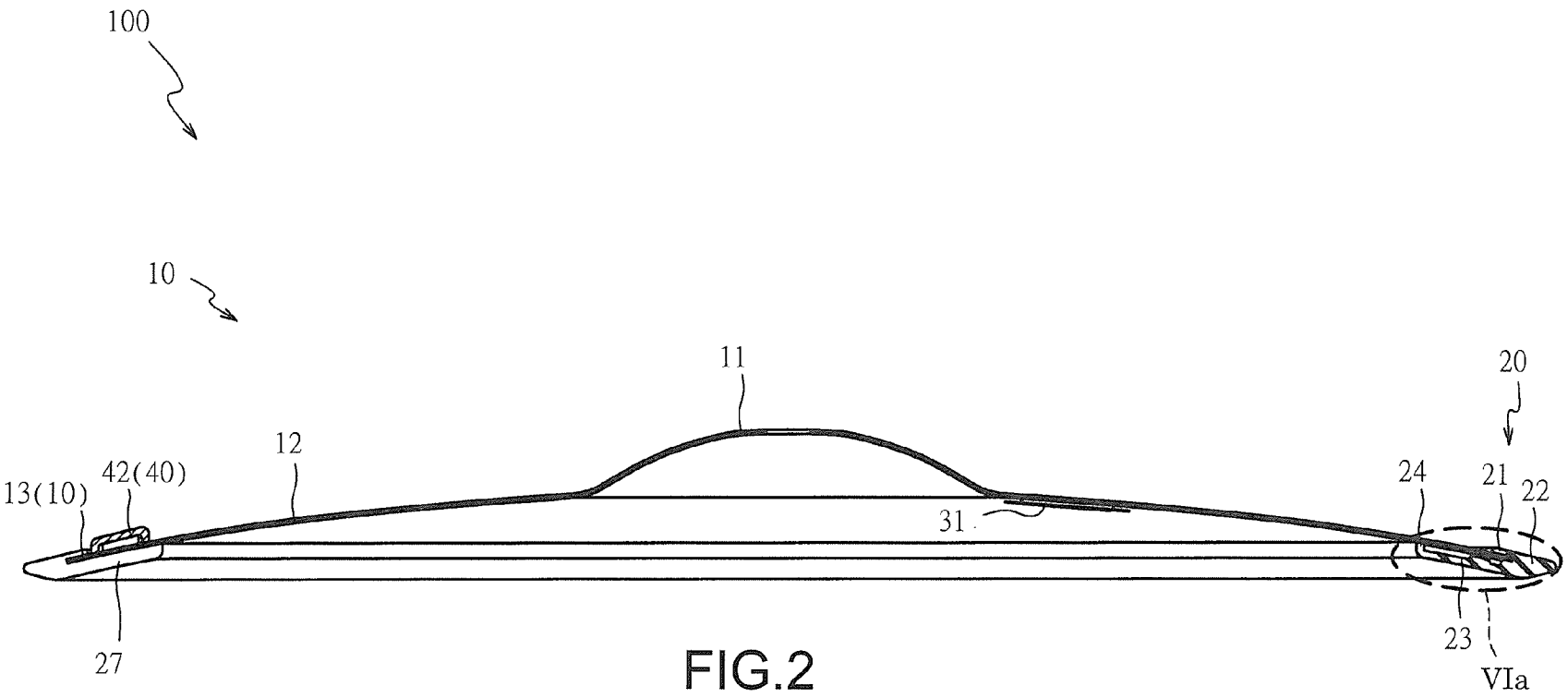
FIG. 2 is a schematic cross-sectional view of the electronic cymbal along the II-II line of FIG. 1A.

Then, with reference to FIG. 2, the main body portion 10 is described hereinafter. FIG. 2 is a schematic cross-sectional view of the electronic cymbal 100 along the II-II line of FIG. 1A. In order to simplify the illustration and make it easy to understand, in FIG. 2, the edge sensor 32 is omitted from the schematic cross-sectional view of the electronic cymbal 100.

As shown in FIG. 2, the main body portion 10 is a member that is formed to simulate the shape of an acoustic cymbal, and the main body portion 10 is formed of brass. The main body portion 10 is provided with a bell portion 11, a bow portion 12, and the edge portion 13. The bell portion 11 is a bowl-shaped portion formed at a central part of the main body portion 10. The bow portion 12 is an annular portion that extends in a flange shape from an outer edge of the bell portion 11. The edge portion 13 is a portion that constitutes an outer circumferential edge portion of the bow portion 12.

Furthermore, two fitting holes 12*a* (see FIG. 5) are formed at the outer circumferential edge portion of the bow portion 12. The main body portion 10 and the covering member 20 are fixed by the fixing member 40 in a state that the covering member 20 is fitted to the fitting holes 12*a*.

Figure 3A:
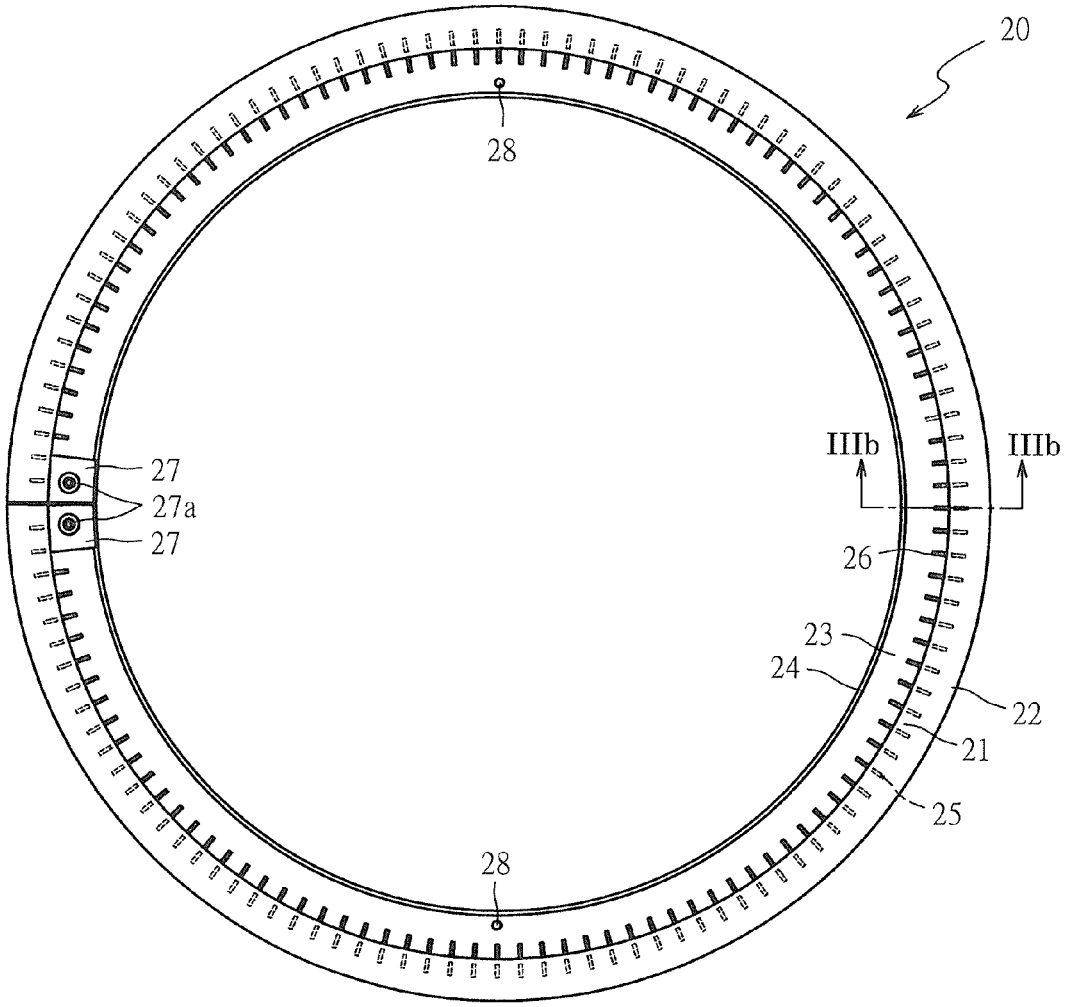
FIG. 3A is a schematic top view of a covering member.
Figure 3B:
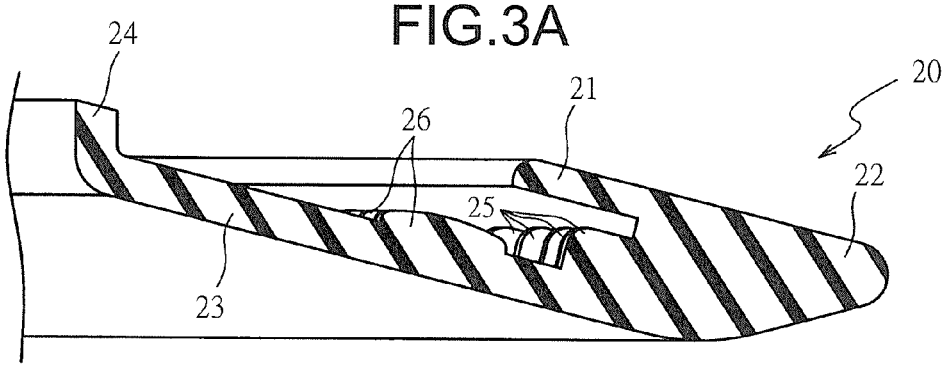
FIG. 3B is a schematic cross-sectional view of the covering member along the IIIb-IIIb line of FIG. 3A.

Next, the covering member 20 is described with reference to FIG. 3. FIG. 3A is a schematic top view of the covering member 20. FIG. 3B is a schematic cross-sectional view of the covering member 20 along the IIIb-IIIb line of FIG. 3A. In FIG. 3A, first upright portions 25 are illustrated schematically by dashed lines.

As shown in FIG. 3A, the covering member 20 is an annular member that is installed to cover the edge portion 13. The covering member 20 is formed of a urethane rubber with a hardness set to 90 degrees (Shore A). A material used for the covering member 20 may be an elastic material, such as natural rubber, synthetic rubber, and elastomer, or a soft resin, such as nylon and vinyl chloride, for example.

The covering member 20 includes an upper covering portion 21, an extending portion 22, a lower covering portion 23, a contact portion 24, a plurality of first upright portions 25, and a plurality of second upright portions 26. The upper covering portion 21 is formed in an annular shape. The extending portion 22 is formed in an annular shape and extends outward from the upper covering portion 21 in a radial direction of the covering member 20. The lower covering portion 23 has an annular shape and extends inward from the extending portion 22 in the radial direction of the covering member 20. The contact portion 24 extends upward (a forward direction of the plane of paper of FIG. 3A) from the lower covering portion 23. The first upright portions 25 are disposed upright on the lower covering portion 23 between the contact portion 24 and the extending portion 22. The second upright portions 26 are disposed upright on the lower covering portion 23 between the first upright portions 25 and the contact portion 24.

The upper covering portion 21 is a portion installed to cover the outer circumferential edge portion of the bow portion 12 (see FIG. 2) from an upper surface side of the main body portion 10. An inner diameter of the upper covering portion 21 is smaller than an outer diameter of the main body portion 10.

The extending portion 22 is a portion that extends further toward an outer circumferential side of the main body portion 10 than the edge portion 13 of the main body portion 10 (see FIG. 2). A dimension of the extending portion 22 in the radial direction is greater than a dimension of the upper covering portion 21 in the radial direction. Moreover, a thickness of the extending portion 22 is greater than a thickness of the upper covering portion 21 and the lower covering portion 23.

The lower covering portion 23 is a portion installed to cover the outer circumferential edge portion of the bow portion 12 from a lower surface side of the main body portion 10. An inner diameter of the lower covering portion 23 is smaller than an inner diameter of the upper covering portion 21. In other words, the lower covering portion 23 extends further toward an inner circumferential side of the covering member 20 than the upper covering portion 21.

A portion of the covering member 20 (the left side of FIG. 3A) is divided along the radial direction. Fitting portions 27 are respectively formed at the divided two ends of the lower covering portion 23 in a circumferential direction, and a thickness of the fitting portion 27 is greater than the thickness of the lower covering portion 23.

Figure 5:
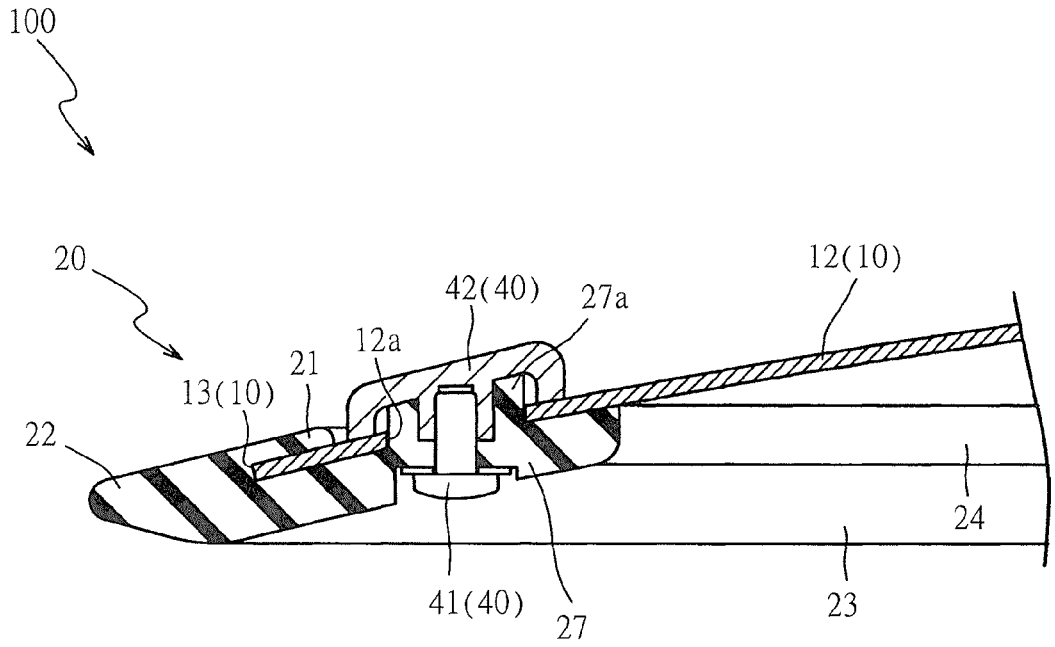
FIG. 5 is a schematic cross-sectional view of the electronic cymbal along the V-V line of FIG. 1A.

The fitting portion 27 is a portion that is to be fitted to the fitting hole 12*a* of the main body portion 10 (see FIG. 5). A fitting cylindrical portion 27*a* is disposed to protrude on a top surface of the fitting portion 27 to be inserted into the fitting hole 12*a*.

In addition, a protruding portion 28 is formed on the covering member 20, and protruding portion 28 protrudes upward from the lower covering portion 23. The protruding portion 28 is a portion that is engaged with the edge sensor 32 (see FIG. 4A). In this exemplary embodiment, two protruding portions 28 are formed at opposite positions (with 180 degrees of phase difference) on the lower covering portion 23.

As shown in FIG. 3B, the contact portion 24 is an annular portion that supports the main body portion 10 from the lower surface side (see FIG. 2). The contact portion 24 extends from an inner circumferential edge portion of the lower covering portion 23.

The first upright portions 25 are portions that support the main body portion 10 from the lower surface side. The first upright portions 25 are arranged side by side with an interval therebetween along the circumferential direction of the lower covering portion 23.

Moreover, each of the first upright portions 25 is formed in a rib shape that extends along the radial direction of the lower covering portion 23. The first upright portions 25 are respectively connected with the extending portion 22 at an outer side in the radial direction. Furthermore, upper end portions of the first upright portions 25 are respectively curved in an arc shape at an inner side in the radial direction.

Figure 4A:
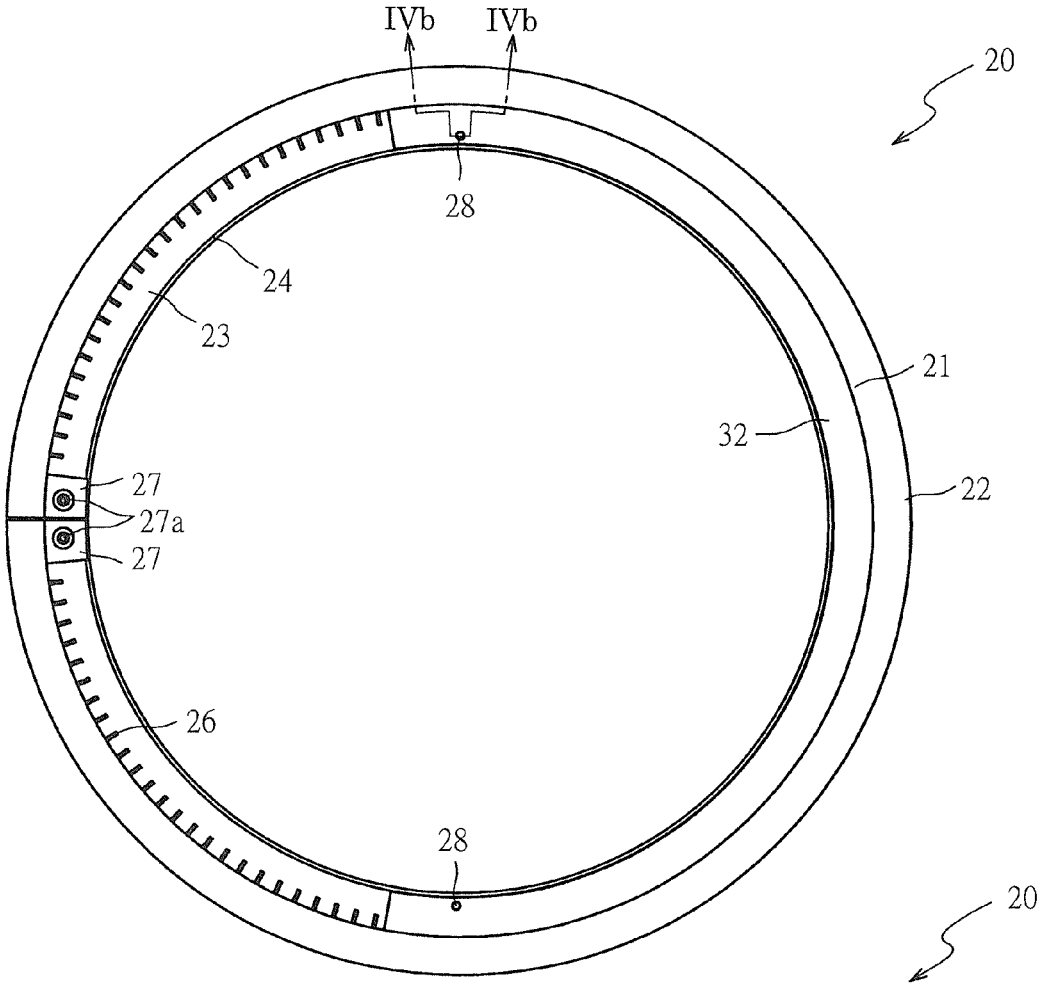
FIG. 4A is a schematic top view of the covering member with an edge sensor installed thereon.

The second upright portions 26 are portions that press the edge sensor 32 (see FIG. 4A). The second upright portions 26 are arranged side by side with an interval therebetween along the circumferential direction of the lower covering portion 23.

Each of the second upright portions 26 is formed in a rib shape that extends along the radial direction of the lower covering portion 23. A height of each second upright portion 26 from the lower covering portion 23 is smaller than a height of the contact portion 24 and the first upright portion 25. Upper end surfaces of the second upright portions 26 are curved in an arc shape.

Then, referring to FIG. 1 again, a vibration sensor 31 is described hereinafter. The vibration sensor 31 is a piezoelectric element for detecting the vibration of the main body portion 10. The vibration sensor 31 is electrically connected to a sound source module (not shown in the figure). A wire for electrically connecting an output terminal (not shown), which is disposed near a center of the main body portion 10, to the vibration sensor 31 is omitted from FIG. 1B.

Figure 4B:
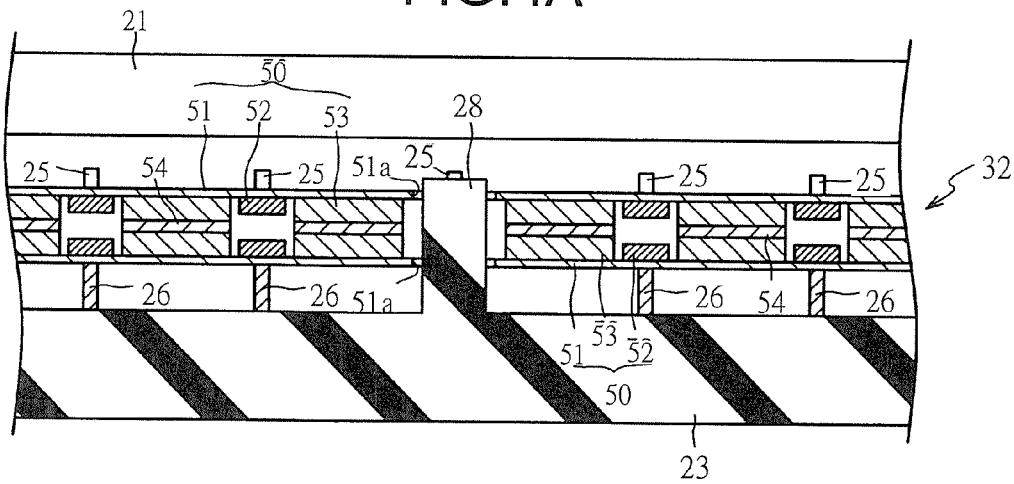
FIG. 4B is a schematic cross-sectional view of the covering member along the IVb-IVb line of FIG. 4A.

Thereafter, the edge sensor 32 is described with reference to FIG. 4. FIG. 4A is a schematic top view of the covering member 20 with the edge sensor 32 installed thereon. FIG. 4B is a schematic cross-sectional view of the covering member 20 along the IVb-IVb line of FIG. 4A. In order to simplify the illustration and make it easy to understand, FIG. 4B schematically illustrates a cross-sectional view of the edge sensor 32. In addition, an outgoing wire of the edge sensor 32 for electrically connecting to the output terminal (not shown) disposed near the center of the main body portion 10 is omitted from FIG. 4A.

As shown in FIG. 4A, the edge sensor 32 is a membrane switch configured to detect a specific performance operation that a performer performs on the covering member 20. The edge sensor 32 is electrically connected to the sound source module (not shown). The edge sensor 32 is disposed above the lower covering portion 23 and supported by the second upright portions 26 in a state of being received between the contact portion 24 and the first upright portions 25 of the covering member 20 (see FIG. 6A).

As shown in FIG. 4B, a thickness of the edge sensor 32 (vertical dimension in FIG. 4B) is smaller than a difference between a height of the contact portion 24 and the first upright portion 25 from the lower covering portion 23 and a height of the second upright portion 26 from the lower covering portion 23. Thus, when the edge sensor 32 is installed on the covering member 20, an upper end of the contact portion 24 and upper ends of the first upright portions 25 protrude above the edge sensor 32.

Here, the edge sensor 32 is formed by adhering a pair of sheet sensors 50 to each other. Each of the sheet sensors 50 includes a film member 51, a plurality of electrode portions 52, and a resist 53. The film member 51 is a film-like member that is formed in an arc shape. The electrode portions 52 are arranged side by side with an interval therebetween along a circumferential direction of the film member 51. The resist 53 is formed adjacent to the electrode portions 52. The resist 53 is adjacent to the electrode portions 52 at both sides of the circumferential direction (two sides in a left-right direction of FIG. 4B) and both sides of the radial direction (two sides in a vertical direction of the plane of paper of FIG. 4B) of the film member 51. The electrode portions 52 and the resist 53 are arranged alternately along the circumferential direction of the film member 51.

Moreover, a height of the resist 53 from the film member 51 is greater than a height of the electrode portion 52 from the film member 51. The resists 53 that are opposite in pair are bonded by an adhesive 54. Thus, when the edge sensor 32 is not pressed, the electrode portions 52 remain in a separated state. On the other hand, when the edge sensor 32 is pressed, the electrode portions 52 come in contact with each other, and an electrical signal is outputted from the edge sensor 32.

In addition, in the sheet sensor 50, the electrode portions 52 are disposed corresponding to the second upright portions 26 formed on the covering member 20. The edge sensor 32 is installed to the covering member 20 in a manner that the phase of the electrode portions 52 and that of the second upright portions 26 match each other.

Here, an engaging hole 51*a* is formed in the film member 51 at a position corresponding to the protruding portion 28 of the covering member 20, and the protruding portion 28 may be inserted into the engaging hole 51*a*. By inserting the protruding portion 28 into the engaging hole 51*a*, the edge sensor 32 is engaged with the covering member 20.

Accordingly, when the edge sensor 32 is installed to the covering member 20, the positions of the electrode portions 52 and the second upright portions 26 can be easily matched by inserting the protruding portion 28 into the engaging hole 51*a*. Further, displacement of the edge sensor 32, which is installed to the covering member 20, with respect to the covering member 20 in the circumferential direction can be suppressed, and therefore, shifting of the phase of the electrode portions 52 and the phase of the second upright portions 26 can be prevented during performance.

Next, the fixing member 40 is described with reference to FIG. 5. FIG. 5 is a schematic cross-sectional view of the electronic cymbal 100 along the V-V line of FIG. 1A.

As shown in FIG. 5, the fixing member 40 includes a bolt 41 and a female thread member 42. The bolt 41 has a shaft-shaped male thread portion with a male thread formed thereon. The female thread member 42 has a recessed female thread hole with a female thread formed on an inner circumferential surface thereof to match the male thread portion of the bolt 41.

An installation method for installing the covering member 20 to the main body portion 10 is explained below. First, while disposing the covering member 20 to cover the edge portion 13 of the main body portion 10, the fitting cylindrical portion 27*a* of the covering member 20 is inserted into the fitting hole 12*a* of the main body portion 10. Since the covering member 20 is divided along the radial direction, the covering member 20 can be installed to the main body portion 10 more efficiently than a covering member 20 formed with no end.

Then, the male thread portion of the bolt 41 is inserted into the fitting cylindrical portion 27*a* from the lower surface side of the main body portion 10. With the male thread portion protruding from the fitting cylindrical portion 27*a* toward the upper surface side of the main body portion 10, the male thread portion of the bolt 41 is screwed to the female thread of the female thread member 42 disposed on the upper surface side of the main body portion 10. Thus, the covering member 20 can be securely fixed to the main body portion 10.

Figure 6A:
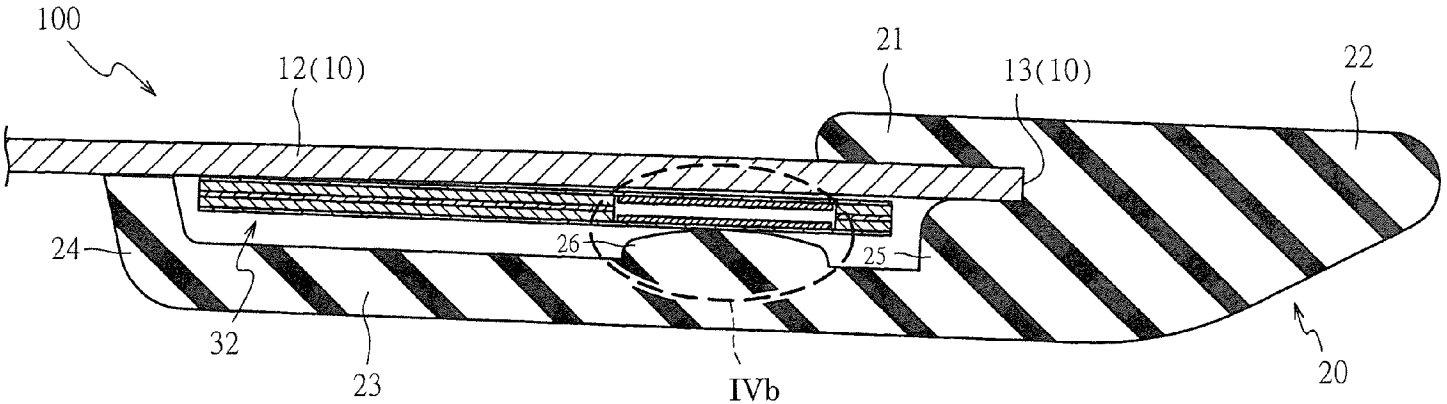
FIG. 6A is a partially enlarged cross-sectional view of a VIa portion of the electronic cymbal of FIG. 2.
Figure 6B:
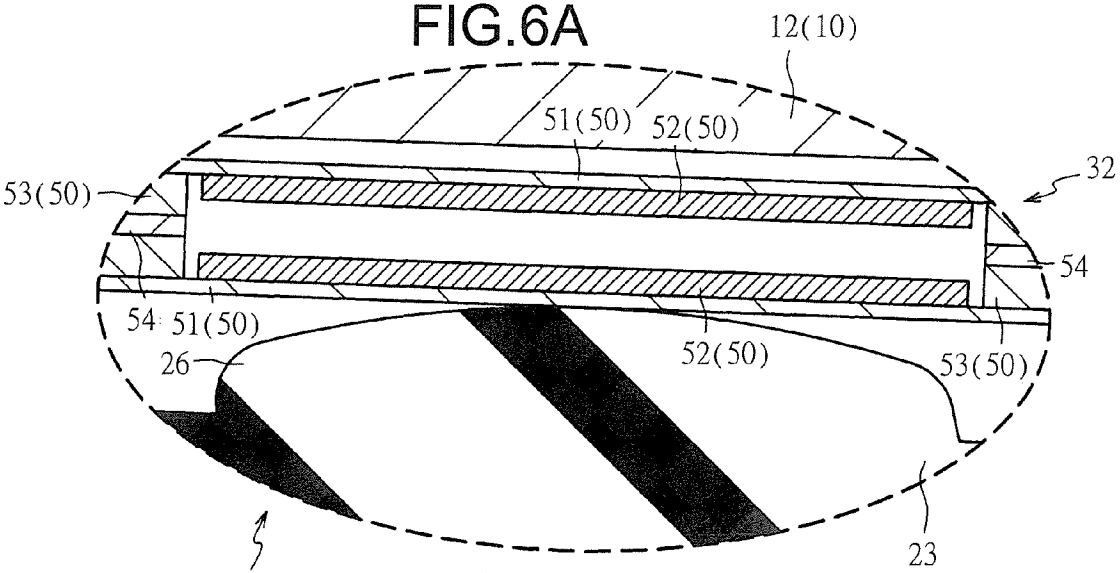
FIG. 6B is a partially enlarged cross-sectional view of a VIb portion of the electronic cymbal of FIG. 6A.
Figure 7A:
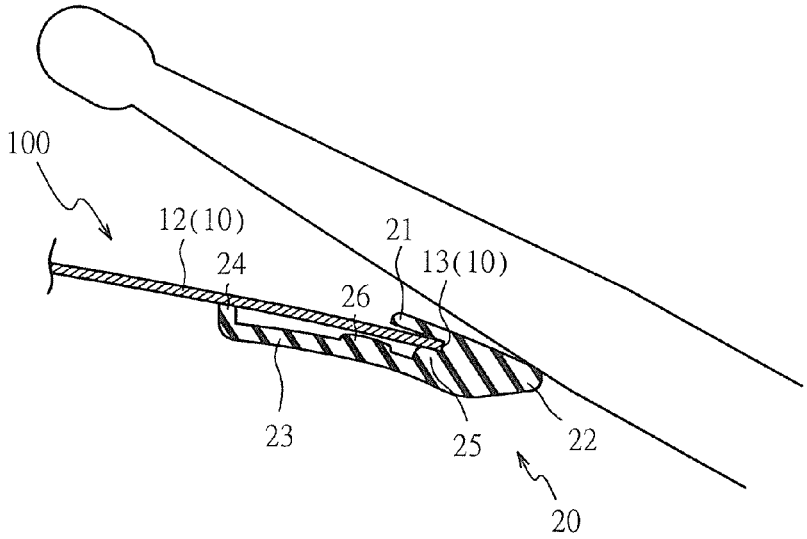
FIG. 7A is a partially enlarged cross-sectional view of the electronic cymbal.
Figure 7B:
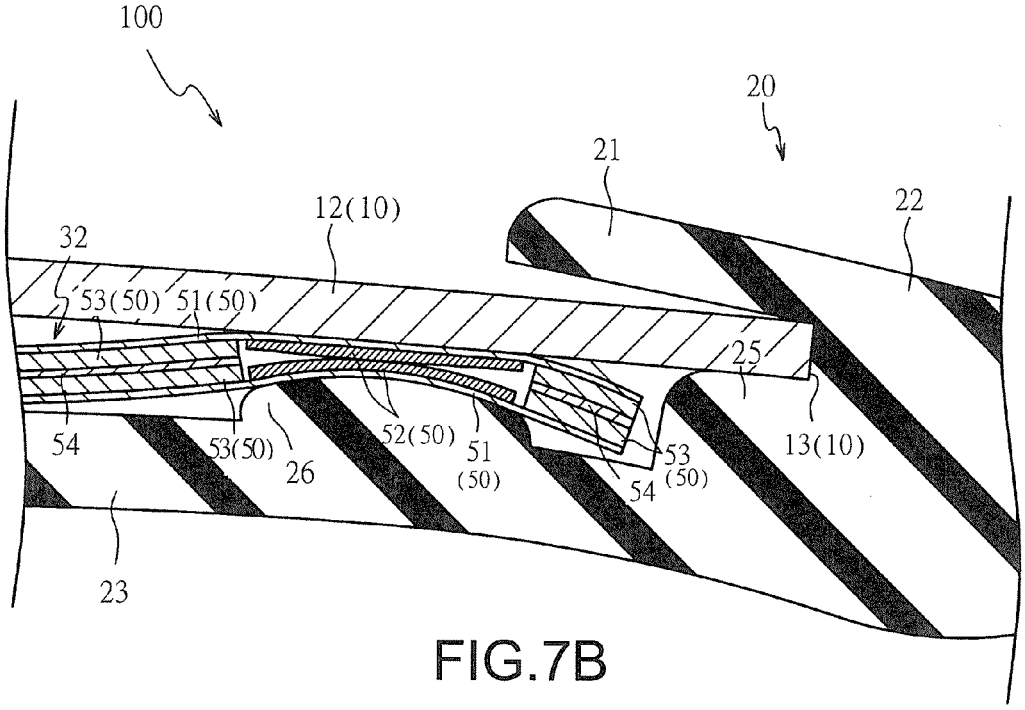
FIG. 7B is a partially enlarged cross-sectional view of the electronic cymbal.
Figure 8:
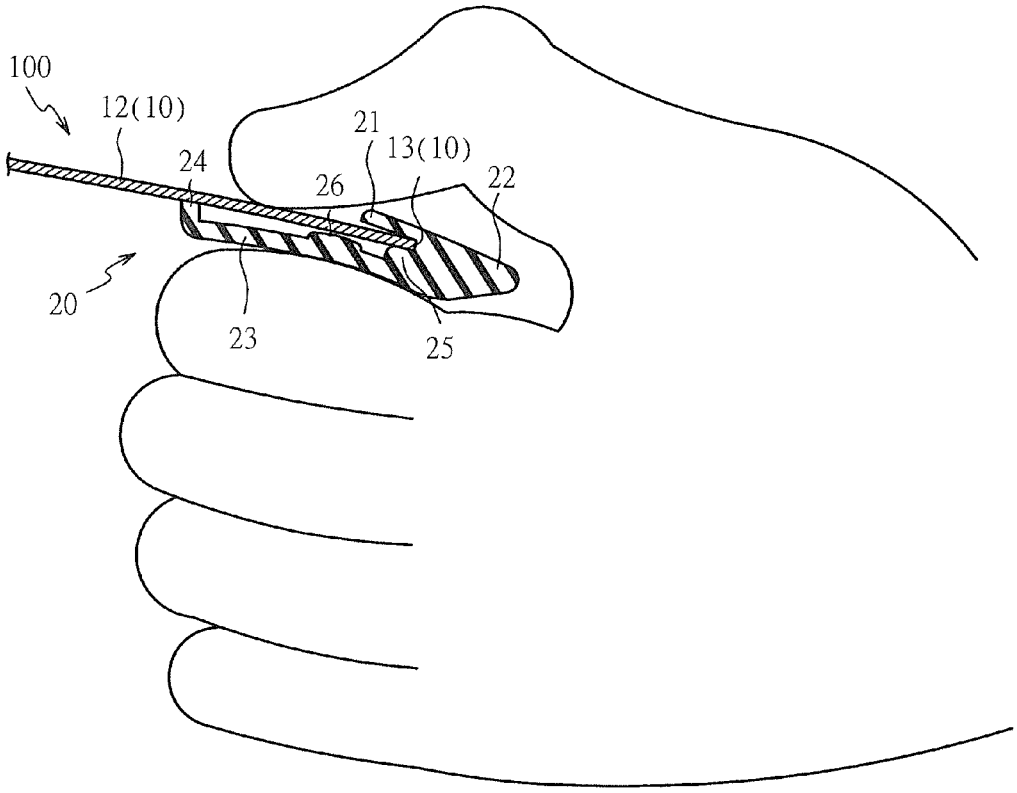
FIG. 8 is a partially enlarged cross-sectional view of the electronic cymbal.

Next, with reference to FIG. 6 to FIG. 8, the structure of the electronic cymbal 100 is described in detail below. FIG. 6A is a partially enlarged cross-sectional view of a VIa portion of the electronic cymbal 100 of FIG. 2. FIG. 6B is a partially enlarged cross-sectional view of a VIb portion of the electronic cymbal 100 of FIG. 6A. FIG. 7A and FIG. 7B are partially enlarged cross-sectional views of the electronic cymbal 100. FIG. 8 is a partially enlarged cross-sectional view of the electronic cymbal 100. FIG. 6A and FIG. 6B schematically illustrate a state of the covering member 20 being installed to cover the edge portion 13 of the main body portion 10. In order to simplify the illustration and make it easy to understand, FIG. 6A and FIG. 6B depict only one of the first upright portions 25 and one of the second upright portions 26. FIG. 7A and FIG. 8 are corresponding to FIG. 6A, and FIG. 7B is corresponding to FIG. 6B respectively. FIG. 7A schematically illustrates a state that the extending portion 22 is being struck by a stick, and FIG. 8 schematically illustrates a state when a choke operation is performed. The edge sensor 32 sandwiched between the lower surface of the main body portion 10 and the second upright portions 26 is omitted from FIG. 7A and FIG. 8.

As shown in FIG. 6A and FIG. 6B, when the covering member 20 is installed to cover the main body portion 10, the upper covering portion 21 covers the outer circumferential edge portion of the bow portion 12 on the upper surface side of the main body portion 10 while a large portion of the bow portion 12 on the upper surface side is exposed without being covered by the upper covering portion 21.

Thus, it is possible to directly strike the main body portion 10, formed of brass, when striking the bow portion 12. Therefore, when striking the bow portion 12, the performer can have a striking feeling similar to striking the acoustic cymbal.

Moreover, the lower covering portion 23 covers the outer circumferential edge portion of the bow portion 12 on the lower surface side of the main body portion 10, and a large portion of the bow portion 12 on the lower surface side is exposed without being covered by the lower covering portion 23. The lower surface side of the bow portion 12 is supported by the upper end of the contact portion 24 and the upper ends of the first upright portions 25 that respectively protrude above the edge sensor 32. Thus, the edge sensor 32 is maintained in a state of being separated from the lower surface of the main body portion 10. That is, the electrode portions 52 in the pair of sheet sensors 50 are maintained in a separated state.

The upper end portions of the first upright portions 25 at the inner side in the radial direction are curved in the arc shape, and the upper end surfaces of the second upright portions 26 are curved in the arc shape as well. When installing the covering member 20 to cover the main body portion 10, the edge portion 13 can be easily inserted between the upper covering portion 21 and the first upright portions 25.

A detection method for detecting a struck position on the electronic cymbal 100 is explained hereinafter.

When the vibration of the main body portion 10 is detected by the vibration sensor 31, an electrical signal that corresponds to the vibration of the main body portion 10 is outputted from the vibration sensor 31 to the sound source module (not shown). The sound source module determines whether the main body portion 10 or the covering member 20 is struck based on the electrical signal outputted from the vibration sensor 31.

Moreover, when the edge sensor 32 is pressed and causes contact between the electrode portions 52 in the pair of sheet sensors 50, an electrical signal is outputted from the edge sensor 32 to the sound source module. The sound source module then determines whether a stroke or a choke operation (an operation of silencing the electronic cymbal 100 by grasping the electronic cymbal 100) is performed on the edge portion 13 based on the electrical signal outputted from the edge sensor 32.

According to the electrical signals outputted from the vibration sensor 31 and the edge sensor 32, the sound source module determines the struck position of the electronic cymbal 100 (that is, determines which of the bell portion 11, the bow portion 12, and the edge portion 13 is struck) or determines whether the choke operation is performed. Then, based on a determination result of the above, a musical sound is generated responsive to the struck position of the electronic cymbal 100 or muted.

Because the upper surface of the main body portion 10 is covered by the upper covering portion 21 and the lower surface of the main body portion 10 is in contact with the contact portion 24 and the first upright portions 25, vibration caused by the striking on the electronic cymbal 10 can be attenuated early by the covering member 20, so as to improve the detection accuracy of the vibration sensor 31.

Next, a detection method for detecting a stroke on the edge portion 13 is explained below.

As shown in FIG. 7A, the edge portion 13 is covered by the covering member 20 and the extending portion 22 extends further toward the outer circumferential side of the main body portion 10 than the edge portion 13. Therefore, the extending portion 22 is struck by the stick when the performer intends to strike the edge portion 13 with the stick. As the extending portion 22 is pushed down by the stroke, the lower covering portion 23 is elastically deformed in a direction toward the main body portion 10.

As shown in FIG. 7B, when the lower covering portion 23 elastically deforms in the direction toward the main body portion 10, the edge sensor 32 is sandwiched between the lower surface of the main body portion 10 and the lower covering portion 23 and is pressed. As a result, the electrode portions 52 in the pair of sheet sensors 50 are in contact with each other and the electrical signal is outputted.

Here, because the lower surface of the main body portion 10 is supported by the contact portion 24 and the first upright portions 25, when the bow portion 12 is struck, elastic deformation of the lower covering portion 23 in the direction toward the main body portion 10 due to the impact is suppressed.

Moreover, in the pair of sheet sensors 50 that constitutes the edge sensor 32, the electrode portions 52 and the resist 53 are arranged alternately along the circumferential direction of the film member 51. In addition, in the pair of sheet sensors 50, the height of the resist 53 from the film member 51 is made greater than the height of the electrode portion 52 from the film member 51, and the opposite resists 53 are bonded to each other by the adhesive 54. Thus, when compared with a situation where the electrode portions 52 are arranged continuously along the circumferential direction of the film member 51, the arrangement of the present invention can suppress contact between the electrode portions 52 due to the impact caused by a stroke on the bow portion 12.

A spacer that has a predetermined thickness may be interposed between the opposite resists 53, and the opposite resists 53 may be bonded through the spacer.

In this way, contact between the electrode portions 52 can be prevented when the bow portion 12 is struck, so as to avoid erroneous judgment that the edge portion 13 is struck.

Besides, because the first upright portions 25 are formed in the rib shape, when the extending portion 22 is struck and pushed down, the first upright portions 25 can be elastically deformed more easily than arc-shaped first upright portions 25 that are connected along the circumferential direction of the covering member 20. As a result, the lower covering portion 23 can be elastically deformed more easily in the direction toward the main body portion 10.

That is to say, with the rib-shaped first upright portions 25, erroneous detection of the edge sensor 32 due to the stroke on the bow portion 12 can be suppressed. In other words, the edge sensor 32 can perform accurate detection when the edge portion 13 is struck.

In addition, the second upright portions 26 are disposed upright on the lower covering portion 23, and the electrode portions 52 in the pair of sheet sensors 50 are disposed at positions corresponding to the second upright portions 26 respectively. Thus, as the lower covering portion 23 is elastically deformed in the direction toward the main body portion 10, the electrode portions 52 can be pushed up by the second upright portions 26.

Therefore, as described above, it is possible to prevent contact between the electrode portions 52 easily when the bow portion 12 is struck, so as to suppress erroneous detection of the edge sensor 32. On the other hand, when the edge portion 13 is struck, the electrode portions 52 can easily contact each other due to the second upright portions 26 for the edge sensor 32 to perform accurate detection.

Furthermore, because the upper end surfaces of the second upright portions 26 are curved in the arc shape, a large contact area between the sheet sensor 50 and the upper end surfaces of the second upright portions 26 can be secured when the electrode portions 52 are pushed up by the second upright portions 26. Thus, in comparison with second upright portions 26 with flat upper end surfaces, the second upright portions 26 with the arc-shaped upper end surfaces of the present invention can easily push up the sheet sensor 50 to facilitate the contact between the electrode portions 52.

Preferably the second upright portions 26 are disposed at positions of the lower covering portion 23 that are closest to the main body portion 10 when the extending portion 22 is pushed down, such that the stroke on the extending portion 22 can be accurately detected by the edge sensor 32.

In addition, the edge sensor 32 is engaged with the covering member 20 by inserting the protruding portion 28 formed on the covering member 20 into the engaging hole 51*a* formed on the film member 51. In comparison with a situation of directly adhering the edge sensor 32 to the lower surface of the main body portion 10, the present invention can suppress damage to the edge sensor 32.

That is, because the main body portion 10 is formed of brass, the main body portion 10 is easy to bend when struck. If one of the sheet sensors 50 is adhered directly to the lower surface of the main body portion 10, displacement of the electrode portions 52 in the pair of sheet sensors 50 or peeling-off of the adhered portions of the pair of sheet sensors 50 may occur and easily cause the problem that no output is generated when the edge sensor 32 is pressed.

In contrast thereto, the edge sensor 32 is installed to the covering member 20 in this embodiment. Thus, the edge sensor 32 remains separated from the main body portion 10 except for specific performance operations (e.g. when the edge portion 13 (the extending portion 22) is struck or when the choke operation is performed). Therefore, the aforementioned problem that may occur to the edge sensor 32 is suppressed.

Regarding the covering member 20, the dimension of the upper covering portion 21 in the radial direction is set smaller than the dimension of the extending portion 22 in the radial direction. When the performer intends to strike the bow portion 12, the performer can easily avoid striking the upper covering portion 21 to strike the bow portion 12 directly, which gives the performer a feeling similar to striking the acoustic cymbal. Moreover, when the performer intends to strike the edge portion 13, the performer can easily strike the extending portion 22 without erroneously striking the upper covering portion 21 or the bow portion 12 exposed by the upper covering portion 21. Accordingly, the stroke on the edge portion 13 can be accurately detected by the edge sensor 32.

As described above, the electronic cymbal 100 is provided with the edge sensor 32 between the lower surface of the main body portion 10 and the lower covering portion 23 for detecting the stroke on the extending portion 22. Because the edge sensor 32 is not disposed on the upper surface side of the main body portion 10, when the performer strikes the bow portion 12, erroneous judgment that mistakes this stroke as a stroke on the edge portion 13 can be suppressed.

In addition, when the performer intends to strike the edge portion 13 with a stick, the structure of the electronic cymbal 100 does not require the stick to press the edge sensor 32 through the covering member 20. Thus, a rubber that has higher hardness can be used for the covering member 20.

That is to say, in a situation that the edge sensor 32 is disposed on the upper surface of the bow portion 12 and covered by a covering member, when the covering member is struck with the stick, the striking force needs to elastically deform the covering member in order to press the edge sensor 32.

In the aforementioned situation, if the rubber has high hardness, the covering member may not be elastically deformed by a weak stroke, which may consequently cause the problem that the pair of electrode portions 52 of the edge sensor 32 does not contact each other. Therefore, in the situation of disposing the edge sensor 32 on the upper surface of the bow portion 12, the hardness of the covering member needs to be lowered to increase elasticity.

Besides, in the situation of disposing the edge sensor 32 on the upper surface of the bow portion 12, the thickness of the covering member needs to be increased so as to press the edge sensor 32 when there is a stroke on the edge portion 13.

That is, when striking the edge portion 13, the performer usually uses a shoulder part of the stick, tilted significantly with respect to the upper surface of the main body portion 10, to strike the edge portion 13. In the case that the covering member has thin thickness, even though the struck portion of the covering member may be elastically deformed by the stroke, an upper part of the edge sensor 32 may not, and it may result in the problem of not successfully pressing the edge sensor 32.

In contrast, the edge sensor 32 of the electronic cymbal 100 is disposed on the lower surface side of the main body portion 10 and the extending portion 22 may be pushed down by a stroke of the stick, etc. Because the structure is to press the edge sensor 32 between the lower covering portion 23 and the lower surface of the main body portion 10, the covering member 20 can have high hardness.

Moreover, like the situation of disposing the edge sensor 32 on the upper surface of the bow portion 12, the thickness of the covering member 20 does not need to be increased. Since the covering member 20 can be thin in thickness, the material cost of the covering member 20 can be reduced. The weight of the covering member 20 can be reduced as well, and therefore it is possible to narrow the weight difference between the electronic cymbal 100 and the acoustic cymbal. As a result, when the performer strikes the electronic cymbal 100, it gives the feeling similar to striking the acoustic cymbal.

In this embodiment, the hardness of the covering member 20 is set to 90 degrees (Shore A). However, the hardness of the covering member 20 may be set in a range of 75 degrees (Shore A) to 97 degrees (Shore A), and more preferably in a range of 80 degrees (Shore A) to 95 degrees (Shore A).

By setting the hardness of the covering member 20 to 75 degrees (Shore A) or more, the lower covering portion 23 can be elastically deformed in the direction toward the main body portion 10 when the extending portion 22 is struck. In other words, the extending portion 22 can be elastically deformed significantly when struck to avoid suppressing the elastic deformation of the lower covering portion 23.

Further, if the hardness of the covering member 20 is less than 80 degrees (Shore A), the friction between the stick and the extending portion 22 increases, as compared with the case of striking the acoustic cymbal with the stick, etc, and thus the stick may be caught by the covering member 20 easily and give the performer a feeling of incongruity that is much different from the feeling of striking the acoustic cymbal.

In contrast thereto, by setting the hardness of the covering member 20 to 80 degrees (Shore A) or more, it is possible to prevent the stick from being caught by the covering member 20 and give the performer the striking feeling similar to striking the acoustic cymbal.

In addition, by setting the hardness of the covering member 20 to 97 degrees (Shore A) or less, or preferably 95 degrees (Shore A) or less, the lower covering portion 23 can be elastically deformed easily when the extending portion 22 is struck. Therefore, even if the edge portion 13 receives a weak stroke, the lower covering portion 23 can still be elastically deformed in the direction toward the main body portion 10 for the edge sensor 32 to accurately detect the stroke on the edge portion 13.

Next, a detection method of the edge sensor 32 for the choke operation is explained hereinafter.

As shown in FIG. 8, when the performer performs the choke operation, the performer grasps the electronic cymbal 100 with fingers, etc., in the same manner as performing with the acoustic cymbal. At the same time, the lower covering portion 23 is pushed up while the main body portion 10 or the upper covering portion 21 is held. Accordingly, the edge sensor 32 is sandwiched between the lower surface of the main body portion 10 and the lower covering portion 23 and pressed.

Furthermore, the dimension of the lower covering portion 23 of the covering member 20 in the radial direction is greater than the dimension of the upper covering portion 21 in the radial direction. Therefore, when performing the choke operation, the performer can easily press the lower covering portion 23 and cause the edge sensor 32 to output the performed choke operation.

As described above, in comparison with the situation of disposing the edge sensor 32 on the upper surface side of the main body portion 10, the structure with the edge sensor 32 disposed on the lower surface side of the main body portion 10 is conducive to reducing the thickness of the covering member 20 (vertical dimension in FIG. 8), which allows the performer to easily grasp the electronic cymbal 100 when performing the choke operation.

Then, the sound source module determines whether the edge portion 13 is struck or the choke operation is performed according to an output time of the electrical signal outputted by the edge sensor 32. That is, if the output time is shorter than a predetermined time, it is determined that the edge portion 13 is struck; and if the output time is longer than the predetermined time, it is determined that the choke operation is performed. Nevertheless, other determination methods may be adopted for the sound source module.

The above illustrates the present invention on the basis of the exemplary embodiments. However, it should be understood that the present invention is not limited to any of the above exemplary embodiments, and various modifications or alterations may be made without departing from the spirit of the present invention.

For example, in the aforementioned exemplary embodiments, the main body portion 10 is formed of brass. However, the present invention is not limited thereto. The main body portion 10 may be formed of other metal materials or a resin material, such as ABS or polycarbonate with high rigidity.

In the aforementioned exemplary embodiments, the edge sensor 32 is installed to the covering member 20. However, the present invention is not limited thereto. The edge sensor 32 may be directly adhered to the lower surface of the main body portion 10.

In the aforementioned exemplary embodiments, the edge sensor 32 is composed of the pair of sheet sensors 50. However, the present invention is not limited thereto. Any sensor that can perform detection when being sandwiched and pressed between the main body portion 10 and the lower covering portion 23 may be used, which may be a conductive rubber sensor or a cable sensor, for example.

In the aforementioned exemplary embodiments, the first upright portions 25 are formed in the rib shape and arranged side by side along the circumferential direction of the covering member 20. However, the present invention is not limited thereto. The first upright portions 25 may also be formed continuously along the circumferential direction of the covering member 20.

In the aforementioned exemplary embodiments, the pair of sheet sensors 50 that constitutes the edge sensor 32 is formed in the arc shape. However, the present invention is not limited thereto. The pair of sheet sensors 50 may also be formed in an annular shape, and in that case, the electrode portions 52 may be disposed on the entire annular film member 51 in the circumferential direction or on only a part of the film member 51.

In the aforementioned exemplary embodiments, the hardness of the covering member 20 as a whole is set to 90 degrees (Shore A). However, the present invention is not limited thereto. The hardness of the elastic material may vary according to different parts of the covering member 20. For example, the hardness of the lower covering portion 23 may be set lower than the hardness of the extending portion 22. In that case, by increasing the hardness of the extending portion 22, the feeling of striking the extending portion 22 can be more similar to the feeling of striking the acoustic cymbal. On the other hand, by decreasing the hardness of the lower covering portion 23, the lower covering portion 23 can be elastically deformed more easily as the extending portion 22 is pushed down. Thus, the edge sensor 32 can generate accurate output when the extending portion 22 is struck.

In the aforementioned exemplary embodiments, the pair of sheet sensors 50, used to form the edge sensor 32, is a pair of membrane switches. However, the present invention is not limited thereto. Sensors of other switch types for detecting ON/OFF or sensors such as piezoelectric sensor for detecting continuous values may also be used to form the edge sensor in place of the membrane switches.

In the aforementioned exemplary embodiments, the electronic cymbal 100 includes the vibration sensor 31 and the edge sensor 32 serving as the striking sensor. However, the present invention is not limited thereto. The vibration sensor 31 may be omitted, and in that case, a piezoelectric sensor, etc., for detecting continuous values, may be used as the edge sensor, and the role of the vibration sensor (such as detection of the striking strength) may be shared by the edge sensor.

What is claimed is:

1. An electronic cymbal, comprising:

a main body portion formed in a disk shape;

a striking sensor detecting a stroke on the main body portion; and a covering member formed of a material having elasticity and disposed to cover an outer circumferential edge portion of the main body portion, wherein the covering member comprises:

an upper covering portion disposed to cover an upper surface side of the main body portion;

an extending portion connected with the upper covering portion and extending further toward an outer circumferential side than the outer circumferential edge portion of the main body portion;

a lower covering portion disposed to cover a lower surface side of the main body portion and extending toward a center side of the main body portion from the extending portion; and a contact portion extending toward the main body portion from the lower covering portion to be in contact with a lower surface of the main body portion, wherein the lower covering portion is maintained in a state of being separated from the lower surface of the main body portion by the contact portion, wherein the striking sensor at least comprises an edge sensor disposed between the lower surface of the main body portion and the lower covering portion; and wherein, by pressing down the extending portion, the lower covering portion is elastically deformed in a direction toward the main body portion to sandwich the edge sensor with the lower covering portion and the main body portion, so as to press the edge sensor.

2. The electronic cymbal according to claim 1, wherein a hardness of the extending portion of the covering member is set in a range of 80 degrees (Shore A) to 95 degrees (Shore A).

3. The electronic cymbal according to claim 1, wherein the covering member comprises a plurality of first upright portions that are disposed upright on the lower covering portion and arranged with an interval therebetween in a circumferential direction of the main body portion, wherein the lower surface side of the main body portion is supported by the plurality of first upright portions, and the edge sensor is disposed between the contact portion and the plurality of first upright portions.

4. The electronic cymbal according to claim 2, wherein the covering member comprises a plurality of first upright portions that are disposed upright on the lower covering portion and arranged with an interval therebetween in a circumferential direction of the main body portion, wherein the lower surface side of the main body portion is supported by the plurality of first upright portions, and the edge sensor is disposed between the contact portion and the plurality of first upright portions.

5. The electronic cymbal according to claim 1, wherein the edge sensor comprises a pair of sheet sensors, and each of the pair of sheet sensors comprises a film member formed in an annular shape or an arc shape, a plurality of electrode portions being conductive and disposed side by side along a circumferential direction of the film member, and a resist being non-conductive and disposed alternately with the plurality of electrode portions along the circumferential direction of the film member, wherein when the plurality of electrode portions are in contact with each other, a pressing on the edge sensor is detected.

6. The electronic cymbal according to claim 2, wherein the edge sensor comprises a pair of sheet sensors, and each of the pair of sheet sensors comprises a film member formed in an annular shape or an arc shape, a plurality of electrode portions being conductive and disposed side by side along a circumferential direction of the film member, and a resist being non-conductive and disposed alternately with the plurality of electrode portions along the circumferential direction of the film member, wherein when the plurality of electrode portions are in contact with each other, a pressing on the edge sensor is detected.

7. The electronic cymbal according to claim 3, wherein the edge sensor comprises a pair of sheet sensors, and each of the pair of sheet sensors comprises a film member formed in an annular shape or an arc shape, a plurality of electrode portions being conductive and disposed side by side along a circumferential direction of the film member, and a resist being non-conductive and disposed alternately with the plurality of electrode portions along the circumferential direction of the film member, wherein when the plurality of electrode portions are in contact with each other, a pressing on the edge sensor is detected.

8. The electronic cymbal according to claim 5, wherein the covering member comprises a plurality of second upright portions that are disposed upright with an interval therebetween along a circumferential direction of the main body portion at a position between the contact portion of the lower covering portion and the extending portion, wherein the edge sensor is disposed between the lower surface side of the main body portion and the lower covering portion in a manner that a phase of the plurality of electrode portions and a phase of the plurality of second upright portions consist with each other.

9. The electronic cymbal according to claim 5, wherein the covering member comprises a protruding portion that protrudes on the lower covering portion, and the edge sensor comprises an engaging hole that is formed at a position corresponding to the protruding portion to be engaged with the protruding portion, so as to install the edge sensor to the covering member.

10. The electronic cymbal according to claim 8, wherein the covering member comprises a protruding portion that protrudes on the lower covering portion, and the edge sensor comprises an engaging hole that is formed at a position corresponding to the protruding portion to be engaged with the protruding portion, so as to install the edge sensor to the covering member.

11. The electronic cymbal according to claim 1, wherein an inner diameter of the lower covering portion is smaller than an inner diameter of the upper covering portion.

12. The electronic cymbal according to claim 1, wherein a dimension of the upper covering portion in a radial direction of the upper covering portion is smaller than a dimension of the extending portion in the radial direction.

13. The electronic cymbal according to claim 1, wherein the edge sensor is engaged with the covering member.

14. The electronic cymbal according to claim 3, wherein each of the plurality of first upright portions is formed in a rib shape and extends along a radial direction of the lower covering portion.

15. The electronic cymbal according to claim 3, wherein an upper end portion of each of the plurality of first upright portions is curved in an arc shape at an inner side in a radial direction of the lower covering portion.

16. The electronic cymbal according to claim 8, wherein each of the plurality of second upright portions is formed in a rib shape and extends along a radial direction of the lower covering portion.

17. The electronic cymbal according to claim 8, wherein an upper end surface of each of the plurality of second upright portions is curved in an arc shape.

18. The electronic cymbal according to claim 8, wherein the covering member comprises a plurality of first upright portions that are disposed upright on the lower covering portion and arranged with an interval therebetween in a circumferential direction of the main body portion, and wherein a thickness of the edge sensor is smaller than a difference between a height of the contact portion and a height of the second upright portion from the lower covering portion and is smaller than a difference between a height of the first upright portion from the lower covering portion and a height of the second upright portion from the lower covering portion.

19. An edge sensor assembly, comprising:

a covering member attached to a cymbal that comprises a main body portion formed in a disk shape, and the covering member being formed of a material having elasticity and disposed to cover an outer circumferential edge portion of the main body portion; and an edge sensor disposed between a lower surface of the main body portion and the covering member and detecting a stroke on the main body portion, wherein the covering member comprises:

an upper covering portion disposed to cover an upper surface side of the main body portion;

an extending portion connected with the upper covering portion and extending further toward an outer circumferential side than the outer circumferential edge portion of the main body portion;

a lower covering portion disposed to cover a lower surface side of the main body portion and extending toward a center side of the main body portion from the extending portion; and a contact portion extending toward the main body portion from the lower covering portion to be in contact with the lower surface of the main body portion, wherein the lower covering portion is maintained in a state of being separated from the lower surface of the main body portion by the contact portion, wherein the edge sensor is at least disposed between the lower surface of the main body portion and the lower covering portion; and wherein, by pressing down the extending portion, the lower covering portion is elastically deformed in a direction toward the main body portion to sandwich the edge sensor with the lower covering portion and the main body portion, so as to press the edge sensor.

* * * * *